US006298927B1

(12) United States Patent
Back

(10) Patent No.: US 6,298,927 B1
(45) Date of Patent: Oct. 9, 2001

(54) PIPE STORAGE AND HANDLING SYSTEM FOR A DRILLING RIG

(75) Inventor: Carl F. Back, Findlay, OH (US)

(73) Assignee: Laibe Corporation, Indianapolis, IN (US)

( * ) Notice: Subject to any disclaimer, the term of this patent is extended or adjusted under 35 U.S.C. 154(b) by 0 days.

(21) Appl. No.: 09/528,308

(22) Filed: Mar. 17, 2000

(51) Int. Cl.[7] ..... E21B 19/14

(52) U.S. Cl. ..... 175/52; 175/85; 166/77.51

(58) Field of Search ..... 175/52, 85, 57, 175/220; 166/77.51, 77.52, 85.1, 85.5

(56) References Cited

U.S. PATENT DOCUMENTS 3,664,439 * 5/1972 Council ..... 175/85
4,380,297 * 4/1983 Frias ..... 211/70.4
4,439,091 * 3/1984 Frias ..... 414/22.59
4,449,592 * 5/1984 Mayer ..... 175/52
4,604,724 * 8/1986 Shaginian et al. ..... 700/213
5,941,324 * 8/1999 Bennett ..... 175/85
6,085,852 * 7/2000 Sparks et al. ..... 175/52

* cited by examiner

*Primary Examiner*—Frank S. Tsay
(74) *Attorney, Agent, or Firm*—Woodard, Emhardt, Naughton, Moriarty & McNett

(57) ABSTRACT

A pipe storage and handling system for storing and manipulating a plurality of drill pipes on a drilling rig. The drilling rig has a mast coupled thereto and a drill head coupled to the mast. A pipe rack is disposed on the drilling rig and includes a number of support members adapted to maintain the drill pipes in at least two pipe columns, with a first of the pipe columns being positioned along a vertical indexing axis. An indexing mechanism is coupled to the drilling rig and is adapted to incrementally index the first pipe column along the indexing axis to successively position the upper-most pipe to a predetermined selection location. A shifting mechanism is coupled between the drilling rig and one of the support members and is adapted to shift a second of the pipe columns in a horizontal direction to thereby position the second pipe column along the indexing axis. A control arm pivotally and rotatably coupled to the drilling rig and disposed adjacent the pipe rack is adapted to remove the upper-most drill pipe from the selection location and reposition the upper-most drill pipe to a connection location for subsequent connection of the upper end of the drill pipe to the drill head.

33 Claims, 10 Drawing Sheets

PIPE STORAGE AND HANDLING SYSTEM FOR A DRILLING RIG

BACKGROUND OF THE INVENTION

1. Field of the Invention

The present invention relates generally to a vehicle-mounted drilling rig for wells and the like, and more particularly to a pipe storage and handling system for storing and manipulating drill pipes.

2. Description of the Prior Art

Mobile drilling rigs are well known and widely used in the drilling industry. Typically, mobile drilling rigs utilize a drilling mast or derrick adapted to be positioned in a generally horizontal position to facilitate transportation of the drilling rig from one location to another, and to be raised to a vertical, upright position to permit drilling. The drill rods or pipes used in the drilling operation are generally quite heavy and typically have a length up to 20'. The size and weight of the drill pipes usually inhibit manual handling. Thus, some type of mechanical means is typically provided to individually orient and position each drill pipe prior to being connected to a drill pipe string, and after the drilling operation is complete, to disconnect each drill pipe from the string and reposition the drill pipes back to their stored position. Moreover, it is desirable that the handling of the drill pipes be performed rapidly in order to reduce the costs associated with labor and fuel, and to obtain a high rate of usage of the drilling rig, which is usually quite expensive. It is also of concern that the handling of the drilling pipes be performed safely in order to avoid serious injury to the operator of the drilling rig.

Prior drilling rigs have utilized various mechanical means for handling and storing the drill pipes. Some drilling rigs include a derrick-mounted boom, or another similar mechanical device, to individually position each drill pipe in a vertical orientation adjacent the derrick for connection to the drill head, and after the drilling operation is complete, to individually remove each drill pipe and transport the pipe back to a storage location on the drilling rig. However, use of such a method to position and orient individual drill pipes typically relies on a considerable amount of manipulation and control by the operator, thus resulting in an increased likelihood of mishandling the drill pipes and correspondingly increasing the possibility of operator injury.

Other prior drilling rigs have attempted to incorporate automated or semi-automated mechanical devices to avoid, or at least minimize, the mishandling of the drill pipes by the operator. In some cases, a rotary magazine or carousel is mounted to the derrick and supported about a vertical rotational axis. The drill head is positioned above the carousel and forms a threaded connection with one drill pipe, and after the drill pipe is used in the drilling operation, the carousel is indexed or rotated about its rotational axis to place another drill pipe into position for subsequent connection to the drill head. Although the use of such automated or semi-automated devices may reduce manipulation and control by the operator, the carousel is only capable of holding a limited supply of drill pipes, typically no more than 7 or 8. After the drill pipes in the carousel are depleted, additional drill pipes must be individually transported from a pipe storage location on the bed of the drilling rig or from another transport vehicle. Typically, it takes too much time to reload the carousel, so any additional drill pipes that are required for completion of the drilling operation must be individually picked from a storage location by a crane or derrick-mounted boom and individually manipulated by the operator to a vertical orientation beneath the drill head.

Thus, carousel-type drilling rigs are presented with some of the same drawbacks and disadvantages associated with conventional drilling rigs when the drilling depth of the well exceeds a certain distance. For instance, in the water well drilling industry, well depths of up to 500' are sometimes required. Because rotary carousels are capable of storing, at most, 140' to 160' of drill pipe length, for wells requiring greater depths, additional drill pipes must be individually manipulated into position by the operator. Moreover, carousel-type drilling rigs have often been expensive, excessively complicated, and subject to costly breakdowns, particularly under severe drilling conditions. Furthermore, a rotary carousel is typically pre-loaded with drill pipes prior to departing for the drill site. The weight of the rotary carousel and the drill pipes contained therein results in a significant shift in the center of gravity of the mobile drilling unit, possibly resulting in decreased vehicle stability during transportation to the drill site. Additionally, due to the increased weight and higher center of gravity of the derrick, when the derrick is placed in its vertical drilling position, the overall stability of the drilling rig is substantially reduced during the drilling operation.

The present invention attempts to remedy at least some of the drawbacks and disadvantages associated with prior drilling rigs by providing a novel and unobvious pipe storage and handling system.

SUMMARY OF THE INVENTION

The present invention relates generally to an apparatus and method for storing and manipulating drill pipes on a drilling rig. While the nature of the invention covered herein is to be determined with reference to the claims appended hereto, particular forms of the invention that are characteristic of certain embodiments of the invention are described briefly below.

According to one embodiment of the present invention, a pipe storage and handling system is provided for storing and manipulating a plurality of drill pipes on a drilling rig. The system comprises a pipe rack disposed on the drilling rig, including: a number of support members adapted to maintain the drill pipes in at least two pipe columns, with one of the pipe columns being positioned along an indexing axis; an indexing mechanism coupled to the drilling rig and adapted to incrementally index the pipe column along the indexing axis to successively position the upper-most pipe to a predetermined selection location; and a shifting mechanism adapted to shift another of the pipe columns in a direction transverse to the indexing axis to thereby position the pipe column along the indexing axis. The system also comprises a control arm disposed adjacent the pipe rack for removing the upper-most pipe from the selection location and repositioning the upper-most pipe to a connection location.

According to another embodiment of the present invention, a method for manipulating drill pipe on a drilling rig is provided, the method comprising: providing a plurality of drill pipes maintained in at least two pipe columns, with a first pipe column being positioned along an indexing axis; indexing the first pipe column in an upward direction along the indexing axis until the upper-most pipe is positioned at a predetermined selection location; repositioning the upper-most pipe to a predetermined connection location; repeating the indexing and repositioning until all of the drill pipes are removed from the first pipe column; and shifting a second pipe column in a direction transverse to the indexing axis until the second pipe column is positioned along the indexing axis.

One object of the present invention is to provide a pipe storage and handling system for storing and manipulating a plurality of drill pipes.

Another object of the present invention is to provide a method for manipulating a plurality of drill pipes.

Related objects, features and advantages of the present invention will become apparent to those skilled in the art upon consideration of the following detailed description.

DESCRIPTION OF THE PREFERRED EMBODIMENTS

Figure 2:
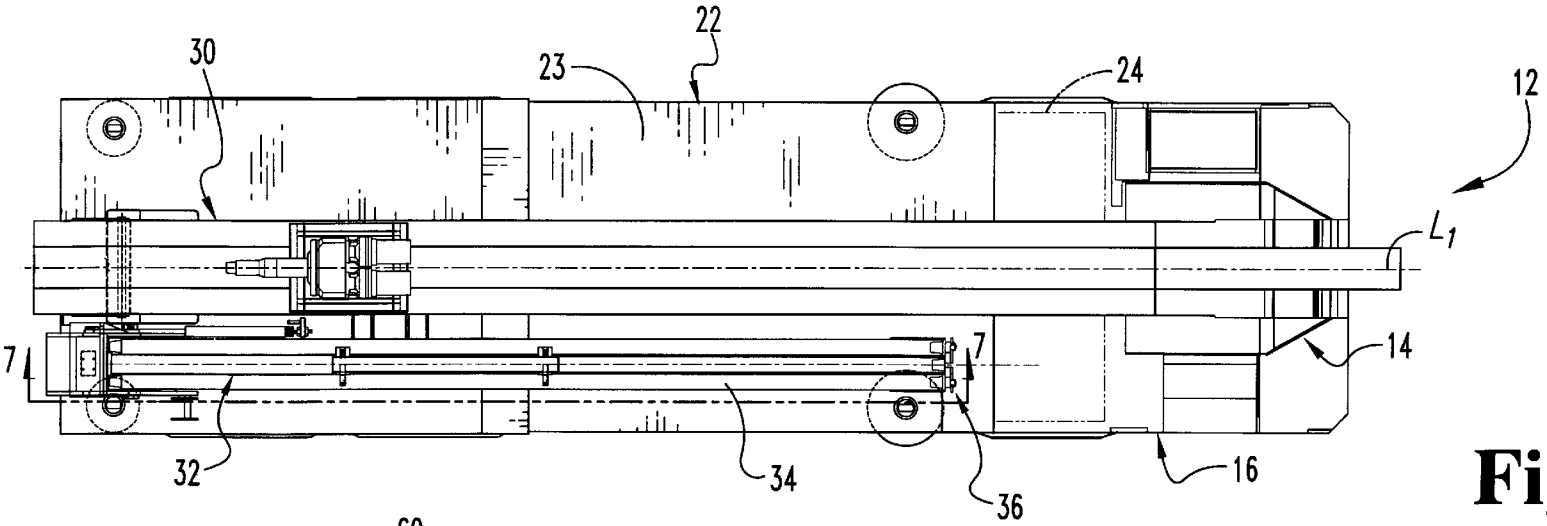
FIG. 2 is a plan view of the mobile drilling rig depicted in FIG. 1.

For the purposes of promoting an understanding of the principles of the invention, reference will now be made to the embodiment illustrated in the drawings and specific language will be used to describe the same. It will nevertheless be understood that no limitation of the scope of the invention is hereby intended, such alterations and further modifications in the illustrated device, and such further applications of the principles of the invention as illustrated herein being contemplated as would normally occur to one skilled in the art to which the invention relates.

Figure 1:
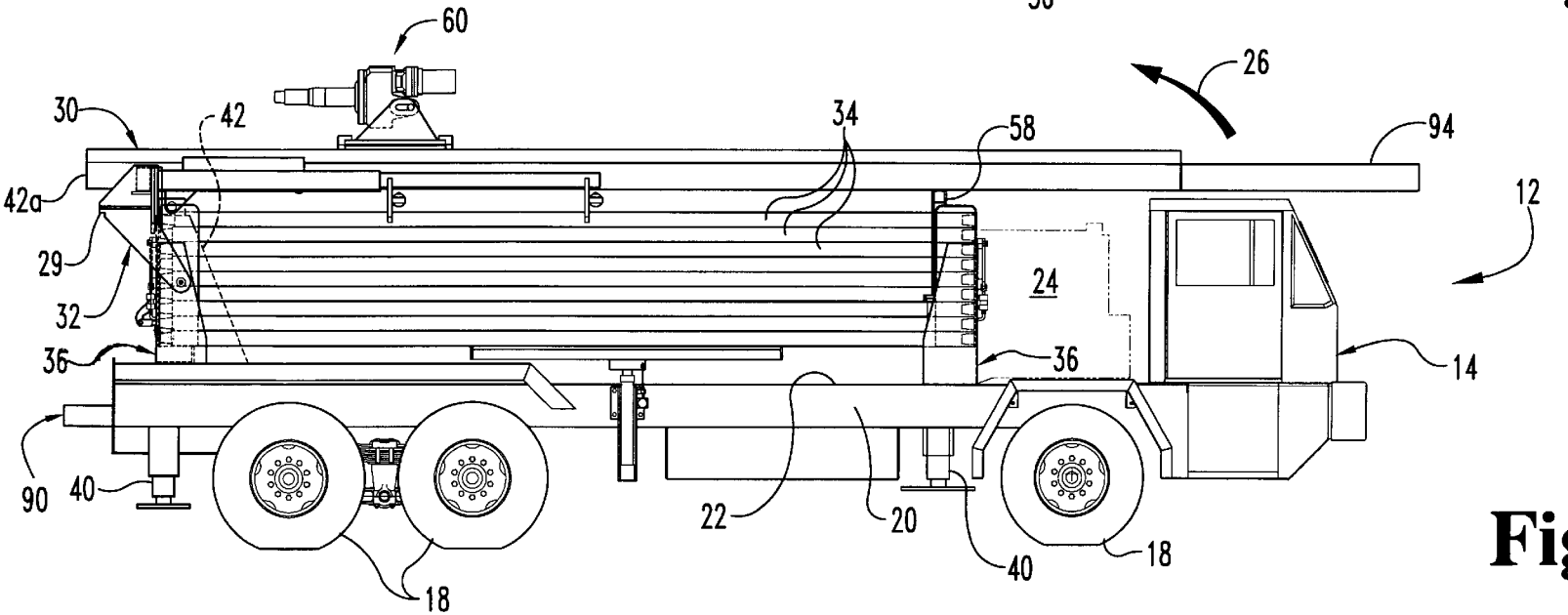
FIG. 1 is a side elevation view of a mobile drilling rig according to one embodiment of the present invention.

Referring now to the drawings in detail, and more particularly to FIGS. 1 and 2, the mobile drilling rig 12 includes a one-man operator's cab 14 centrally mounted to a chassis 16. Chassis 16 is supported for travel by a front axle and a rear tandem axle, to which are attached a plurality of wheels 18 having pneumatic tires mounted thereon. The chassis 16 includes a spaced pair of elongated steel frame members 20 (FIG. 1) tied together by suitable cross members and bracing members (not shown), all designed to give the chassis 16 the necessary structural strength and rigidity. Steel frame members 20 support an elongated chassis bed 22 formed by a layer of steel plating 23. Drill operating machinery is mounted to chassis bed 22, including a diesel engine 24 and other mechanical components (not shown) such as a transmission, a drive train assembly, a combination drop box and hydraulic pump assembly, a series of mud pumps, an air compressor, and an operator control console for controlling and monitoring various drilling functions.

Mounted toward the rearward end of chassis bed 22 is a derrick assembly 30, pivotally coupled to chassis bed 22 for movement in the direction of arrow 26 between a substantially horizontal transport position (as shown) and a substantially vertical drilling position. Also mounted to chassis bed 22 adjacent derrick assembly 30 is a pipe control arm assembly 32, pivotally and rotatably coupled to chassis bed 22 and adapted to reorient individual drill pipes 34 from a substantially horizontal attitude (as shown) to a substantially vertical attitude for drilling. A pipe storage and control rack assembly 36 extends longitudinally along chassis bed 22 and is adapted to store and manipulate a plurality of drill pipes 34. Notably, pipe rack assembly 36 is positioned closer to the longitudinal centerline of the chassis bed 22 than is typically the case with pipe storage systems of conventional drilling rigs. One advantage of such positioning includes providing greater stability to drilling rig 12 during transportation to and from the drill site. Pipe rack assembly 36 operates to successively position individual drill pipes 34 to a predetermined selection location $l_s$ (FIG. 3) for removal and repositioning by pipe control arm assembly 32 to a predetermined connection location $l_c$ (FIG. 4). A plurality of hydraulically operated leveling jacks 40 are provided on the forward and rearward portions of chassis 16 to assist in the leveling and stabilization of drilling rig 12 before and during a drilling operation.

Although drilling rig 12 is hereinafter discussed in association with the drilling of water wells, it should be understood that drilling rig 12 can also be used to drill for other purposes or in conjunction with other types of wells. Additionally, a notable advantage of the drilling rig 12 illustrated and described above is that the drilling rig may be transported to a drilling site with a sufficient number of drill pipes 34 to accommodate water well depths of up to 500' when using 4½" diameter drill pipes, or well depths up to 620' when using 3½" diameter drill pipes. Thus, there is typically no need for a support vehicle to transport additional drill pipes 34 to the drilling site. This reduces transportation and set-up costs and provides for a more economical drilling operation.

Figure 3:
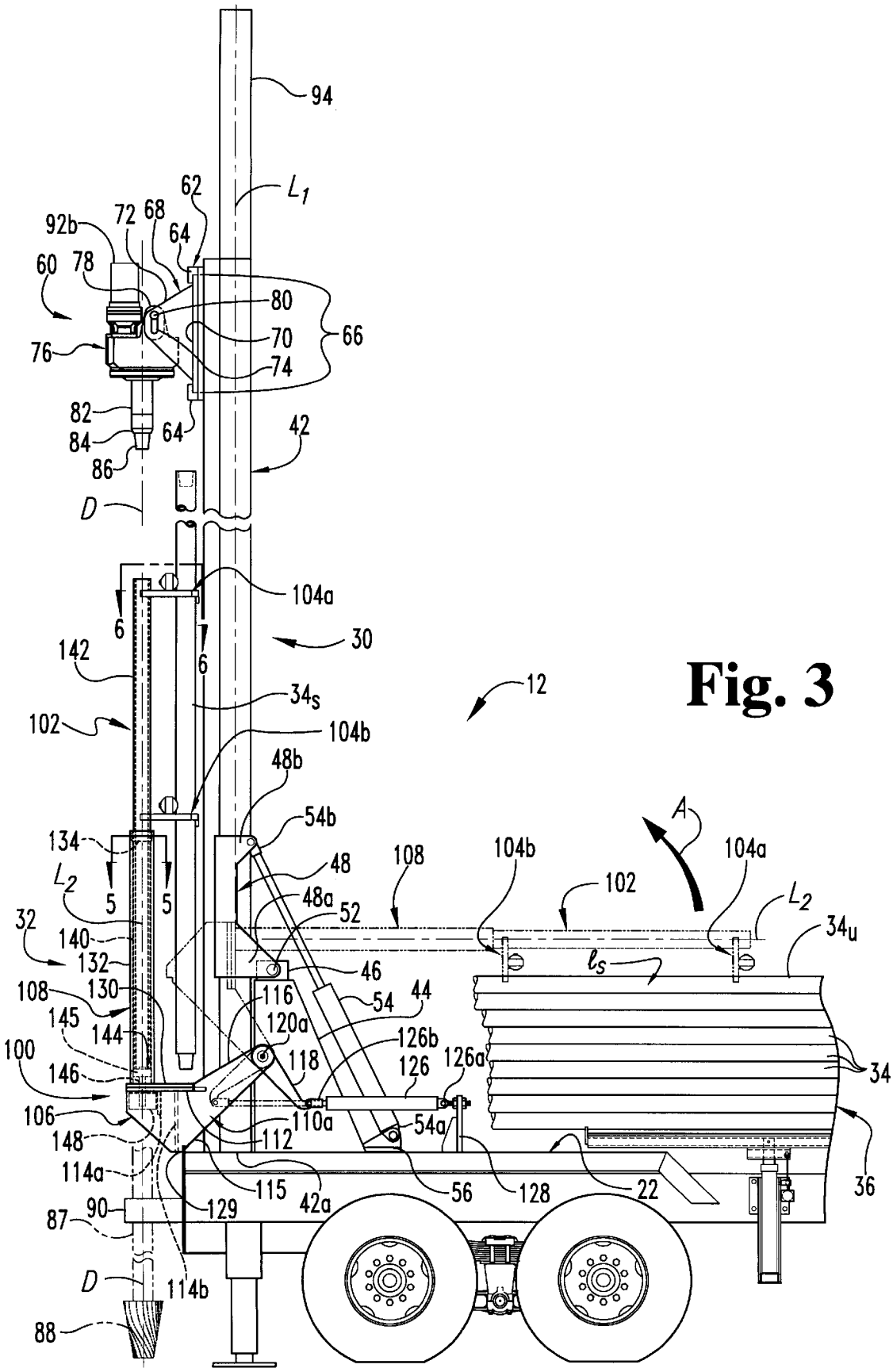
FIG. 3 is a partial cross sectional view of the mobile drilling rig showing the derrick and control arm positioned in a vertical orientation.
Figure 4:
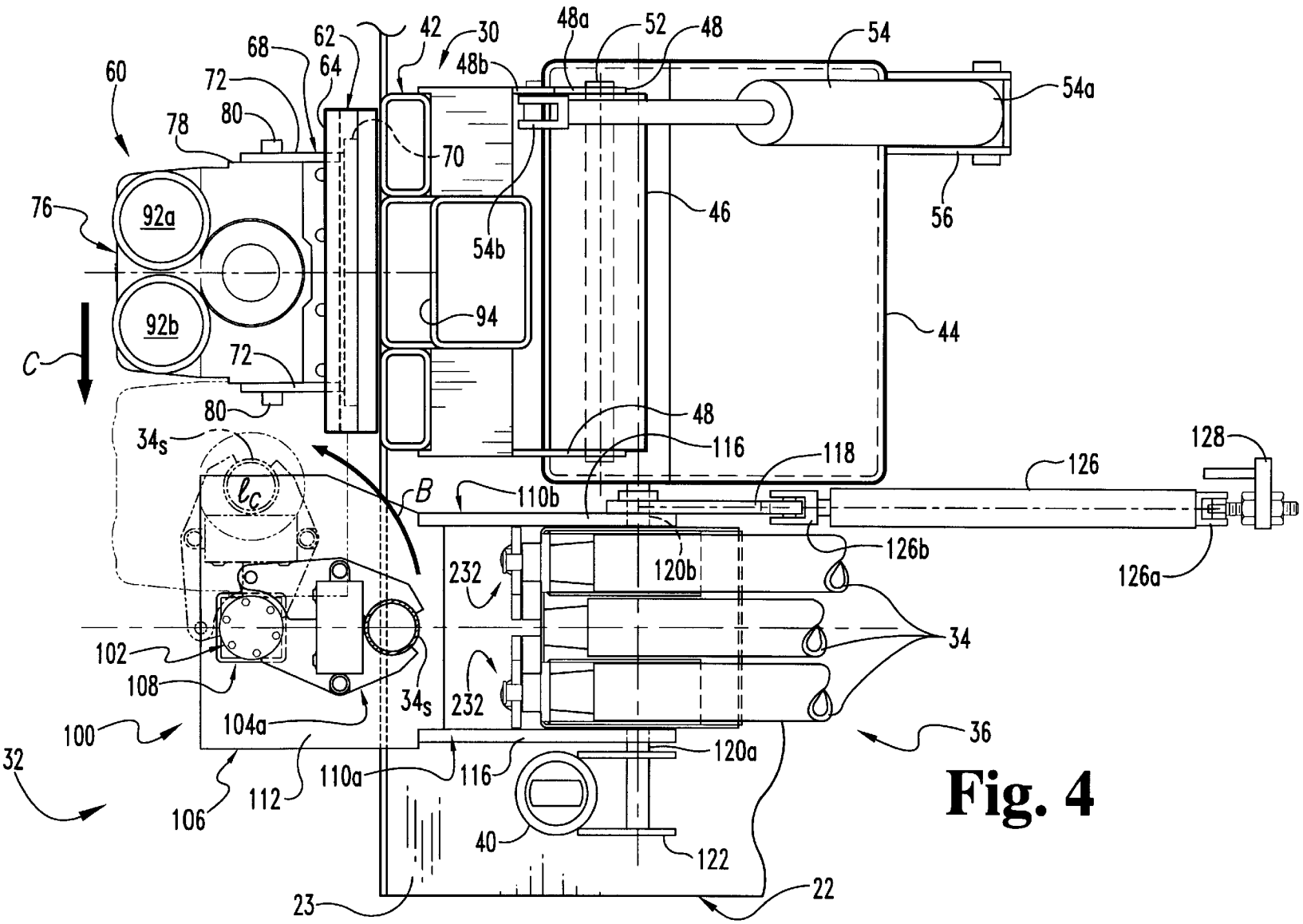
FIG. 4 is a top view of the derrick and control arm shown in FIG. 3.

Referring now to FIGS. 3 and 4, derrick assembly 30 and pipe control arm assembly 32 are each shown in an upright, vertical orientation suitable for drilling. Derrick assembly 30 includes a tower or mast 42 defining a longitudinal axis $L_1$ and pivotally coupled to the rearward end of chassis bed 22 by way of a derrick support pedestal 44. A hinge journal 46 is securely attached to a top portion of support pedestal 44, preferably by welding. A pair of hinge plates 48 are securely attached to opposite sides of mast 42, preferably by welding. Hinge plates 48 have opposing bottom portions 48*a* that are spaced apart to define a yoke. Hinge journal 46 is received between the hinge plates 48 and a hinge pin 52 extends through hinge journal 46 and hinge plates 48 to thereby pivotally attach mast 42 to support pedestal 44. A double-acting, single rod-end hydraulic lifting cylinder 54 has a cylinder end 54*a* pivotally mounted to chassis bed 22 by pinning cylinder end 54*a* to a mounting bracket 56 securely attached to chassis bed 22. The rod end 54*b* of lifting cylinder 54 is pivotally mounted to mast 42 by pinning rod end 54*b* to a top portion 48*b* of hinge plate 48 (see FIG. 4).

Lifting cylinder 54, shown in a fully extended position, is operable to pivot the mast 42 between a substantially horizontal transportation position (as shown in FIGS. 1 and 2) and a substantially vertical drilling position (as shown in FIG. 3) by selectively extending and retracting lifting cylinder 54. When mast 42 is in its transportation position, the forward portion of mast 42 is supported by a support bracket 58 mounted to chassis bed 22 in a substantially vertical orientation (FIG. 1). When mast 42 is in its vertical drilling position, the lower end 42*a* of the mast 42 rests on the chassis bed 22 to provide additional stability to mast 42 during a drilling operation (FIG. 3).

A drill head assembly 60 is operably coupled to mast 42 to provide for vertical displacement generally along longitudinal axis $L_1$ and horizontal displacement generally perpendicular to longitudinal axis $L_1$. Drill head assembly 60 includes a first mounting plate 62 which is operably coupled to mast 42 to allow drill head assembly 60 to translate up and down along mast 42. In one embodiment, the first mounting plate 62 is driven up and down along longitudinal axis $L_1$ by way of a two-stage hydraulic cylinder. In such embodiment, the first mounting plate 62 is capable of being vertically displaced a distance of 26' along longitudinal axis $L_1$. It should be understood that first mounting plate 62 could alternatively be vertically displaced by utilizing other hydraulically actuated drive systems, such as, for example, a rack and pinion system or a chain and sprocket system, the details of which would be known to one of ordinary skill in the art. Another possibility would be an internal gear track feed system, including a gear track driven by one or more hydraulic cylinders. Further details regarding an internal gear track feed system are disclosed in U.S. Pat. No. 5,697,457 to Back, the contents of which are hereby incorporated by reference.

First mounting plate 62 includes a pair of horizontally disposed guiding portions 64, spaced apart to define a horizontal guide track 66. A second mounting plate 68 includes a vertical plate 70 sized to be slidably received within guide track 66 to allow the second mounting plate 68 to move sideways within horizontal guiding portions 64. In one embodiment, second mounting plate 68 is driven horizontally within guide track 66 by a hydraulic cylinder (not shown); however, other means for horizontally displacing second mounting plate 68 relative to first mounting plate 62 are also contemplated as being within the scope of the invention. In one embodiment, second mounting plate 68 is capable of being horizontally displaced 16½" relative to the mast 42.

Second mounting plate 68 also includes a pair of clevis plates 72 extending horizontally from opposite ends of the front surface of vertical plate 70. Each pair of clevis plates 72 defines a yoke therebetween (not shown) and a vertically extending slot 74. A drill-driving top head 76 is coupled to the second mounting plate 68 so as to be vertically and horizontally displaceable therewith. Top head 76 has two horizontally spaced hanger posts 78 spaced apart so that each fits inside of the yoke of a corresponding pair of clevis plates 72. Top head 76 is mounted to second mounting plate 68 by passing a pin 80 through each hanger post 78 and the corresponding pair of clevis plates 72. The vertically extending slots 74 enable top head 76 to float relative to second mounting plate 68 to avoid potential damage to the top head 76 or the drill pipes during the connection and separation of a drill pipe string. Further details regarding the mounting of top head 76 to second mounting plate 68 are disclosed in U.S. Pat. No. 5,697,457 to Back.

Extending downwardly from top head 76, along drilling axis D, is a drill coupling stem 82. A wear sub 84 is connected to coupling stem 82 and includes an externally threaded nipple 86 configured to engage a corresponding internal thread in drill pipe 34. Drill pipes 34 are threadedly connected end-to-end to form a drill pipe string, extending generally along drill axis D, wherein the lower-most pipe 87 (shown in phantom) has a drill bit 88 attached to its lower end in a conventional manner. Each pipe, when added to the drill pipe string, is guided by a bearing table 90 extending from the rear end of chassis 16 to ensure that the drill pipe string is maintained along drill axis D during a drilling operation. Drill coupling stem 82 is rotatably driven by a pair of hydraulic drill motors 92*a*, 92*b*, which are each attached to an upper surface of top head 76. Preferably, one of the drill motors 92*a*, 92*b* is a low-speed/high torque motor, while the other drill motor is a high-speed/low torque motor, to accommodate for varying drilling conditions and environments. It should be understood that other rotational drive means can alternatively be used to drive top head 76 as would occur to one of ordinary skill in the art.

Although not required for operation of the present invention, a jib boom (not shown) may be rotatably attached to the distal or upper-most end portion 94 of mast 42 to allow for the manual manipulation of drill pipes, a drill pipe stabilizer, or other drilling components. A hoist line is suspended from the jib boom and is powered by a hydraulic winch for raising or lowering the hoist line. In one embodiment, the jib boom is capable of rotating 250° relative to the mast 42, and the hoist line has a length of at least 65'.

Referring to FIG. 3, pipe control arm assembly 32 is shown pivotally mounted to the rearward end of chassis bed 22 adjacent derrick assembly 30. Pipe control arm assembly 32 is configured to pivot through a vertical plane in the direction of arrow A from a substantially horizontal orientation (shown in phantom) to a substantially vertical orientation (shown in solid). As shown in FIGS. 3–4, the control arm assembly 32 is comprised of a pedestal member or base 100 pivotally coupled to the chassis bed 22, an elongate tube member 102 rotatably coupled to the pedestal member 100, and a pair of upper and lower clasp members 104*a*, 104*b* coupled to elongate member 102 and adapted to selectively grasp a drill pipe 34. Pedestal member 100 includes a lower base portion 106 and an upper bearing portion 108. Lower base portion 106 includes a pair of vertically oriented support arms 110*a*, 110*b*, interconnected by a horizontal mounting plate 112 and a pair of vertically disposed brace plates 114*a*, 114*b*. Preferably, support arms 110*a*, 110*b*, horizontal mounting plate 112, and brace plates 114*a*, 114*b* are welded together to form a unitary construct. Support arms 110*a*, 110*b* each include a mounting portion 115 and a pivot arm portion 116 extending in an upward direction from mounting portion 115 toward the front of chassis bed 22. Extending downwardly from the distal end of pivot arm portion 116 of support arm 110*b* is a lever arm 118. Preferably, lever arm 118 is oriented substantially perpendicular to pivot arm portion 116. Pedestal member 100 is pivotally connected to chassis bed 22 by a pair of opposing, horizontal pins 120*a*, 120*b* passing through the distal ends of corresponding pivot arm portions 116 of support arms 110*a*, 110*b*. Pin 120*a* is supported by mounting bracket 122 (FIG. 4), which is secured to chassis bed 22. Pin 120*b* is rotatably mounted to derrick support pedestal 44 by a bearing (not shown) mounted to an interior surface of pedestal 44. A hydraulic pivoting cylinder 126 has a cylinder end 126*a* pivotally mounted to chassis bed 22 by way of a mounting bracket 128, and a rod end 126*b* pivotally attached to a lower end portion of lever arm 118. Pivoting cylinder 126 is operable to pivot the control arm assembly 32 between the horizontal and vertical operating positions by selectively extending and retracting cylinder 126. The lower portion of each of the support arms 110*a*, 110*b* defines a substantially square notch 129 (FIGS. 1 and 3) which is configured to engage the rear edge of the chassis bed 22. This interaction between notch 129 and the rear edge of the chassis bed 22 helps to stabilize the control arm assembly 32 when the control arm assembly 32 is in its vertical operating position (shown in solid lines) during a drilling operation.

Figure 5:
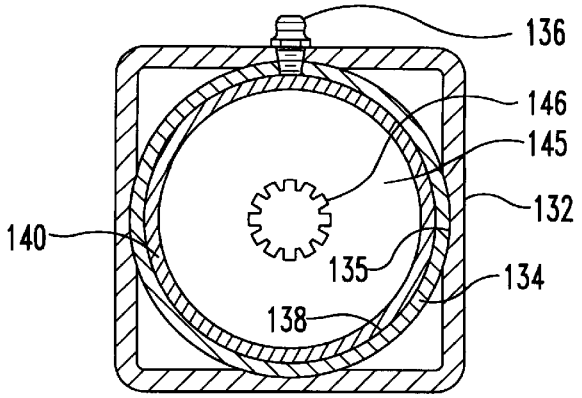
FIG. 5 is a cross sectional view of the control arm taken at line 5—5 of FIG. 3.

Upper bearing portion 108 of pedestal member 100 includes a base plate 130 and an elongate support tube 132 extending perpendicularly from base plate 130 and defining a longitudinal axis $L_2$. Base plate 130 is securely attached to horizontal mounting plate 112 by a plurality of fasteners (not shown) or by any other method known to one of ordinary skill in the art. Referring to FIGS. 3 and 5, a bronze bushing 134 is mounted within a counter-bore 135 defined in the distal end portion of support tube 132. A grease fitting 136 passes through the support tube 132 and the bronze bushing 134 to supply lubrication to the internal surface 138 of bronze bushing 134.

Elongate member 102 includes a lower portion 140 disposed within support tube 132 and rotatably supported within bronze bushing 134, and an upper portion 142 to which is attached upper and lower clasp members 104*a*, 104*b*. Lower portion 140 has an outer diameter sized slightly smaller than the inner diameter of bronze bushing 134. A hub assembly 144 is attached to the lower end of lower portion 140 and includes a hub plate 145 welded to the lower portion 140 and a splined shaft 146 extending perpendicularly from hub plate 145 along longitudinal axis $L_2$. The lower end of lower portion 140 rests on the base plate 130, and splined shaft 146 extends through the base plate 130 and the mounting plate 112. A hydraulic rotary actuator 148 is mounted to brace plate 114*a* of lower base portion 106 and cooperates with splined shaft 146 to rotate elongate member 102 about longitudinal axis $L_2$ in the direction of arrow B (FIG. 4).

As shown in FIG. 3, control arm assembly 32 is provided with a pair of spaced apart clasp members 104*a*, 104*b* for grasping individual drill pipes 34. The drill pipes 34 are maintained in the pipe rack assembly 36 in a substantially horizontal orientation and upper and lower clasp members 104*a*, 104*b* are operable to selectively grasp the upper-most drill pipe $\mathbf{34}_u$ located in the predetermined selection location $l_s$ and reorient the selected drill pipe $\mathbf{34}_s$ to a substantially vertical orientation. In one embodiment, upper and lower clasp members 104*a*, 104*b* are separated by a distance along longitudinal axis $L_2$ that is at least 25% of the length of the drill pipes 34. Such a spacing provides stabilization to the selected drill pipe $\mathbf{34}_s$ while being repositioned and reoriented by the control arm assembly 32. However, it should be understood that lesser separation distances are also contemplated. It should also be understood that a single clasp member can alternatively be used to grasp the drill pipes 34. The upper and lower clasp members 104*a*, 104*b* are of identical construction and are each attached to the upper portion 142 of elongate member 102, extending radially outward relative to longitudinal axis $L_2$.

Figure 6:
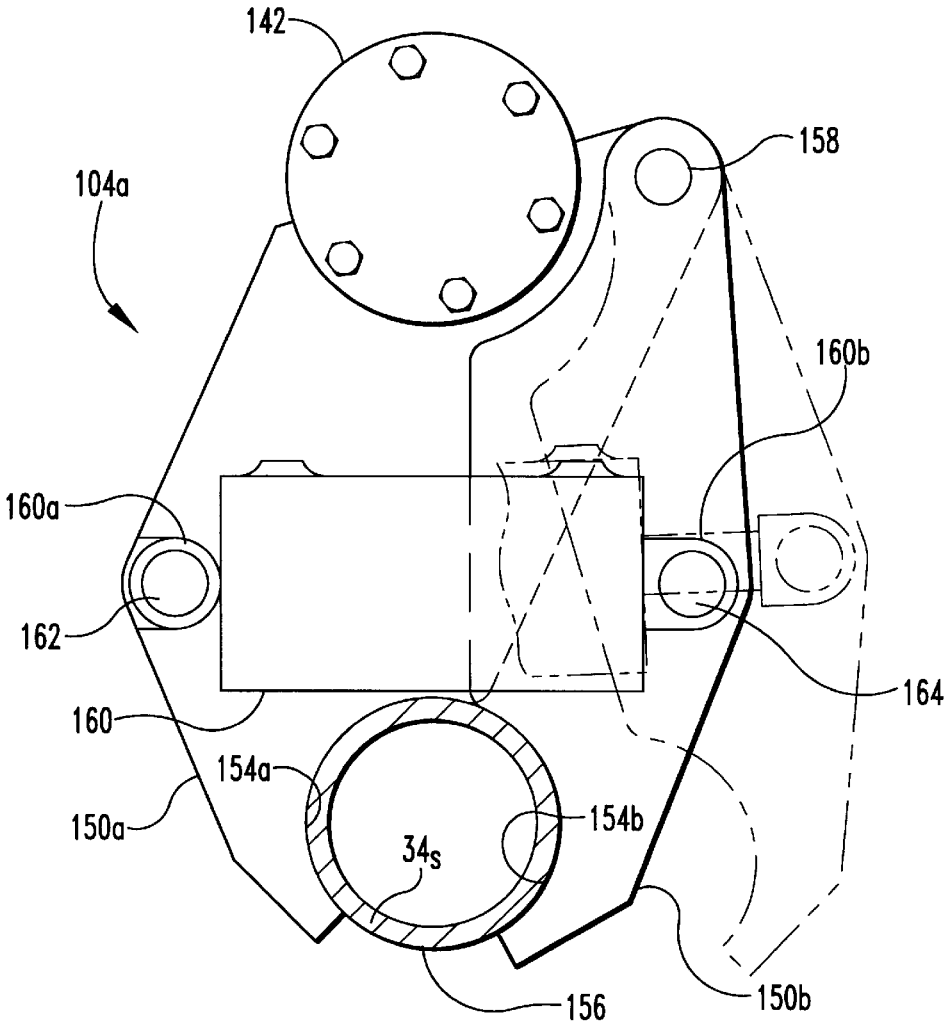
FIG. 6 is a cross sectional view of the control arm taken at line 6—6 of FIG. 3, showing the control arm pipe clamp in an engaged position, as clamped to a selected drill pipe.

Referring to FIG. 6, upper clasp member 104*a* is shown in an engaged position (shown in solid) in which the selected drill pipe $\mathbf{34}_s$ is securely clamped between opposing jaws 150*a*, 150*b*, and a disengaged position (shown in phantom) in which the selected drill pipe $\mathbf{34}_s$ is released from the opposing jaws 150*a*, 150*b*. Each pair of opposing jaws 150*a*, 150*b* cooperate to define a seat formed by opposing concave surfaces 154*a*, 154*b* configured to engage and clamp tightly about an outer surface 156 of the selected drill pipe $\mathbf{34}_s$. One of the jaws 150*a* is securely attached to upper portion 142 of elongate member 102 in a stationery position, while the otherjaw 150*b* is pivotally connected to opposingjaw 150*a* by a hinge pin 158, extending through opposing jaws 150*a*, 150*b*, such that jaw 150*b* is pivotable relative to stationery jaw 150*a*. In the illustrated embodiment, jaw 150*a* is fabricated from a single plate, while opposing jaw 150*b* is fabricated from a pair of identical, spaced apart plates disposed adjacent opposite sides of jaw plate 150*a*.

The pivotal movement of jaw 150*b* relative to jaw 150*a* is controlled by a hydraulic clamping cylinder 160, having a cylinder end 160*a* pivotally connected to a mid-section of jaw 150*a* by a pin 162, and a rod end 160*b* pivotally connected to a mid-section of jaw 150*b* by a pin 164. When the clamping cylinder 160 is extended, jaw 150*b* will open toward a disengaged position (in phantom). Clasp members 104*a*, 104*b* can then be disposed directly above the selection location $l_s$ (FIG. 3) and opposing concave surfaces 154*a*, 154*b* positioned adjacent the upper-most drill pipe $\mathbf{34}_u$. When the clamping cylinder 160 is retracted, the opposing jaws 150*a*, 150*b* will close toward an engaged position (in solid), wherein opposing concave surfaces 154*a*, 154*b* will be pressed tightly against the outer surface 156 of the upper-most drill pipe $\mathbf{34}_u$ so as to securely grip the selected drill pipe $\mathbf{34}_s$ therebetween. After the selected drill pipe $\mathbf{34}_s$ is raised in the direction of arrow A (FIG. 3) and swung in the direction of arrow B (FIG. 4) to the connection location $l_c$ (FIG. 4), the drill head stem 86 is threaded into the selected drill pipe $\mathbf{34}_s$. The clamping cylinder 160 is then once again extended to open the opposing jaws 150*a*, 150*b* and release the selected drill pipe $\mathbf{34}_s$. Then, the control arm 32 is returned to its horizontal orientation (shown in phantom in FIG. 3) over the pipe rack, ready to pick up the next upper-most drill pipe $\mathbf{34}_u$. Although the illustrated embodiment shows jaw 150*a* mounted in a stationary position relative to elongate member 102, it should be understood that both of the opposing jaws 150*a*, 150*b* could be pivotally coupled to elongate member 102, such that both of the jaws would move relative to elongate member 102 upon the extension and retraction of clamping cylinder 160.

Figure 7:
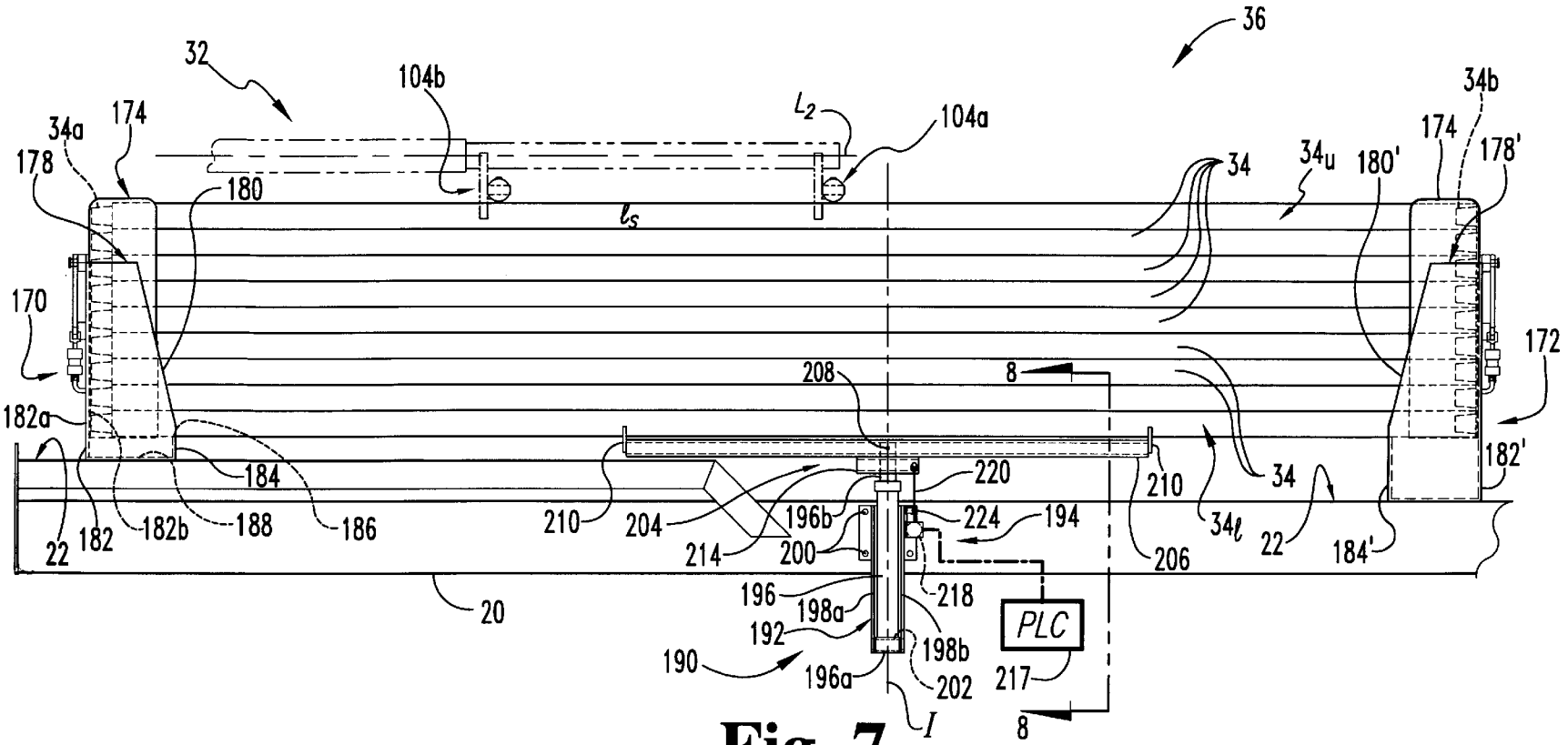
FIG. 7 is a side elevation view of the mobile drilling rig showing the pipe storage and control rack with the vertical indexing cylinder in a retracted position.
Figure 8:
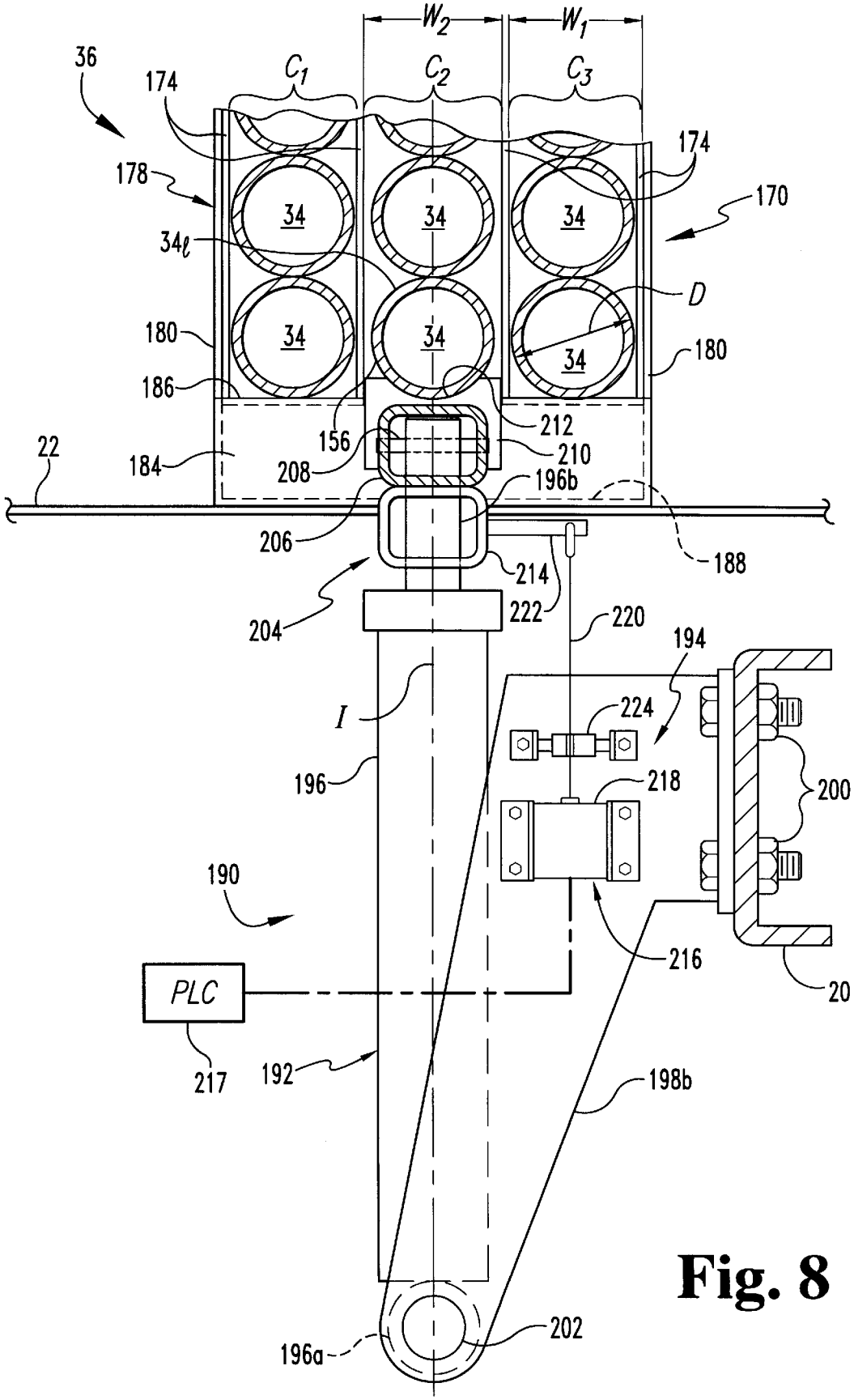
FIG. 8 is a cross sectional view of the pipe storage and handling system taken at line 8—8 of FIG. 7.

Referring now to FIGS. 7 and 8, shown therein is the pipe storage rack assembly 36, which includes a rearward pipe support assembly 170 and a forward pipe support assembly 172 for maintaining a plurality of horizontally disposed drill pipes 34 in three adjacent and substantially parallel pipe columns $C_1$, $C_2$, $C_3$. In one embodiment, the drill pipes 34 are fabricated from 4130 alloy steel tubing having a length of 20 feet and an outer diameter of 4½". Each drill pipe 34 has a first externally threaded end portion $\mathbf{34}_a$ and a second internally threaded end portion $\mathbf{34}_b$, each defining standard API pipe threads. A number of drill pipes 34 are threadedly connected end-to-end to form a drilling string, with each new length of pipe 34 being connected to the drill head 76 (FIG. 3) and threaded into the previous length of drill pipe 34 already in the ground. The drill string is rotated about drilling axis D to thereby drill a hole in the earth in a conventional manner.

Pipe support assemblies 170, 172 have the capacity to store up to twenty-five drill pipes 34, with each of the outer pipe columns $C_1$, $C_3$ containing eight drill pipes and the inner pipe column $C_2$ containing nine drill pipes (including the upper-most drill pipe $34_u$ initially stored and maintained in the predetermined selection location $l_s$). Thus, pipe rack assembly 36 has the capacity to store enough drill pipes 34 to produce a drilling string up to 500' in length. Since approximately 95% of water wells have a depth of 500' or less, there is rarely a need to transport additional drill pipe to the drilling site by way of a separate pipe transport vehicle.

Rearward pipe support assembly 170 includes a pair of substantially U-shaped support members or boots 174, each having a channel width $W_1$ slightly wider than the outer diameter D of the drill pipes 34. The support members 174 serve to capture and maintain the rearward portions of the drill pipes 34 in outer pipe columns $C_1$, $C_3$. The support members 174 are spaced apart so as to define a cavity 176, having a width $W_2$ slightly greater than width $W_1$, in which are disposed the rearward portions of the drill pipes 34 of inner pipe column $C_2$. Thus, the inner pipe column $C_2$ is not supported by a separate support member, but is instead maintained between oppositely facing side walls of the outer support members 174, the importance of which will become apparent below. Rearward pipe support assembly 170 also includes a substantially U-shaped mounting bracket 178, having a pair of vertical side walls 180 spaced apart a sufficient distance to accommodate pipe columns $C_1$, $C_2$, $C_3$ therebetween. Mounting bracket 178 also includes a vertical end wall 182, having an outer surface 182*a* and an oppositely facing inner surface 182*b* disposed adjacent the rearward ends 34*a* of drill pipes 34. Mounting bracket 178 further includes a vertical support flange 184 disposed between side walls 180 opposite end wall 182, having a top edge 186 on which rests the lower-most drill pipes 34 of pipe columns $C_1$, $C_2$, $C_3$. A bottom wall 188 of mounting bracket 178 is fastened to chassis bed 22, preferably by a plurality of fasteners (not shown).

Forward pipe support assembly 172 is substantially identical to rearward pipe support assembly 170, including a pair of support members 174 which capture and maintain the forward end portions 34*b* of the drill pipes 34 in vertical pipe columns $C_1$, $C_2$, $C_3$. However, mounting bracket 178' has side walls 180', an end wall 182' and a flange 184', each having a somewhat greater height than their counterparts of mounting bracket 178. This difference in height serves to accommodate for a change in elevation along the chassis bed 22 and to ensure that the drill pipes 34 are maintained in a substantially horizontal orientation.

Pipe storage rack assembly 36 also includes a pipe lifting assembly 190 disposed beneath drill pipes 34 and comprising an indexing mechanism 192 and an indexing control system 194 (FIG. 8). Indexing mechanism 192 includes a two-stage, single rod end hydraulic indexing cylinder 196, preferably having a useable stroke of approximately 43". Indexing cylinder 196 has a cylinder end 196*a* coupled to steel frame member 20 by a pair of spaced apart mounting brackets 198*a*, 198*b*, which are attached to frame member 20 by a plurality of fasteners 200. A pin 202 extends through mounting brackets 198*a*, 198*b* and passes through a lower portion of cylinder end 196*a* to couple indexing cylinder 196 to chassis frame member 20 and to maintain indexing cylinder 196 in a substantially vertical orientation directly beneath inner pipe column $C_2$.

Indexing mechanism 192 also includes a pipe saddle assembly 204 adapted to engage the lower-most drill pipe $34_l$ in inner pipe column $C_2$. Pipe saddle 204 includes a lifting beam 206 connected to the rod end 196*b* of indexing cylinder 196 by a cross pin 208. Contoured end plates 210 are attached to opposite ends of lifting beam 206, each defining a cradle or seat 212 configured to engage the outer surface 156 of the drill pipes 34. In one embodiment, lifting beam 206 has an overall length that spans at least one-third of the length of the drill pipes 34 to aid in balancing the drill pipes during the indexing process. A support block 214 is welded to the underside of lifting beam 206 and disposed along the rod end 196*b* of indexing cylinder 196 to provide additional stability to the pipe saddle assembly 204 and to help maintain lifting beam 206 in a substantially horizontal orientation.

Indexing mechanism 192 defines an indexing axis I which is disposed in a substantially vertical orientation and positioned directly beneath inner pipe column $C_2$. Thus, as the indexing cylinder 196 is extended, the inner pipe column $C_2$ will be correspondingly displaced in an upward direction along the indexing axis I until the upper-most drill pipe $34_u$ is positioned in the predetermined selection location $l_s$ (FIG. 7). At this point, the control arm assembly 32 will selectively grasp and remove the upper-most drill pipe $34_u$ from the selection location $l_s$ and will reposition the selected drill pipe to a connection location $l_c$ (FIG. 4) for subsequent engagement to the drill head 76. Indexing cylinder 196 is once again extended a distance equal to the outer diameter D of the drill pipes 34, thereby incrementally indexing inner pipe column $C_2$ along indexing axis I until another of the drill pipes 34 is positioned in the predetermined selection location $l_s$. The process of removing and repositioning the upper-most drill pipe $34_u$ and incrementally indexing the inner pipe column $C_2$ is repeated until all of the drill pipes 34 are removed from the inner pipe column $C_2$.

Indexing control system 194 is provided to automate the indexing process and to insure that the upper-most drill pipe $34_u$ is reliably and repeatedly positioned in the predetermined selection location $l_s$. To that end, indexing control system 194 includes a sensor 216 configured to monitor the vertical position of the inner pipe column $C_2$ during vertical displacement along the indexing axis I, and to generate an output signal corresponding to the vertical position. A programmable logic controller 217 ("PLC"), or any other suitable computing device, is provided to receive the output signal from the sensor 216 and to compare the output signal to a target criterion corresponding to the vertical displacement of indexing cylinder 196 required to position the upper-most drill pipe $34_u$ in the predetermined selection location $l_s$. An example of a suitable programmable logic controller is manufactured by Rex Roth under Part No. MC6; however, other suitable PLCs are also contemplated as would occur to one of ordinary skill in the art. The PLC 217 generates a control signal when the output signal corresponds to the target criterion. The indexing mechanism 192 receives the control signal and responds by ceasing the indexing of the indexing cylinder 196 to prevent further vertical displacement of the inner pipe column $C_2$, thereby positioning the upper-most drill pipe $34_u$ in the predetermined selection location $l_s$. The target criterion is determined by the PLC 217 from a look-up table of values which are programmed and stored within the PLC 217, the values corresponding to the outer diameter of the drill pipes 34.

In one embodiment of the invention, the sensor 216 is an optical encoder having a base portion 218 stationarily mounted to the indexing cylinder mounting bracket 198*b*, and a displaceable cable 220 attached to a horizontal stem 222 extending perpendicularly from support block 214 of pipe saddle assembly 204. Cable 220 is wrapped around a springloaded spool 224, which is also mounted to the indexing cylinder mounting bracket 198*b*. Thus, as the pipe saddle assembly 204 is vertically displaced along indexing axis I, the cable 220 will be correspondingly displaced and will cause the base portion 218 to generate an output signal corresponding to the vertical position of the inner pipe column $C_2$. An example of a suitable optical encoder is manufactured by Allen Bradley under Part No. 845T-DZ13ECR, and a suitable spring-loaded spool is manufactured by Rex Roth under Part No. 4WE6E6X-EG12N9K4. It should be understood that other sensing devices are also contemplated as being within the scope of the invention. For example, a number of mechanical limit switches, or other similar proximity sensors, could be used in place of the optical encoder. It should also be understood that ancillary components, such as a hydraulic shifting valve, are required to control the extension and retraction of the indexing cylinder 196, the details of which would be evident to one of ordinary skill in the art.

Figure 9B:
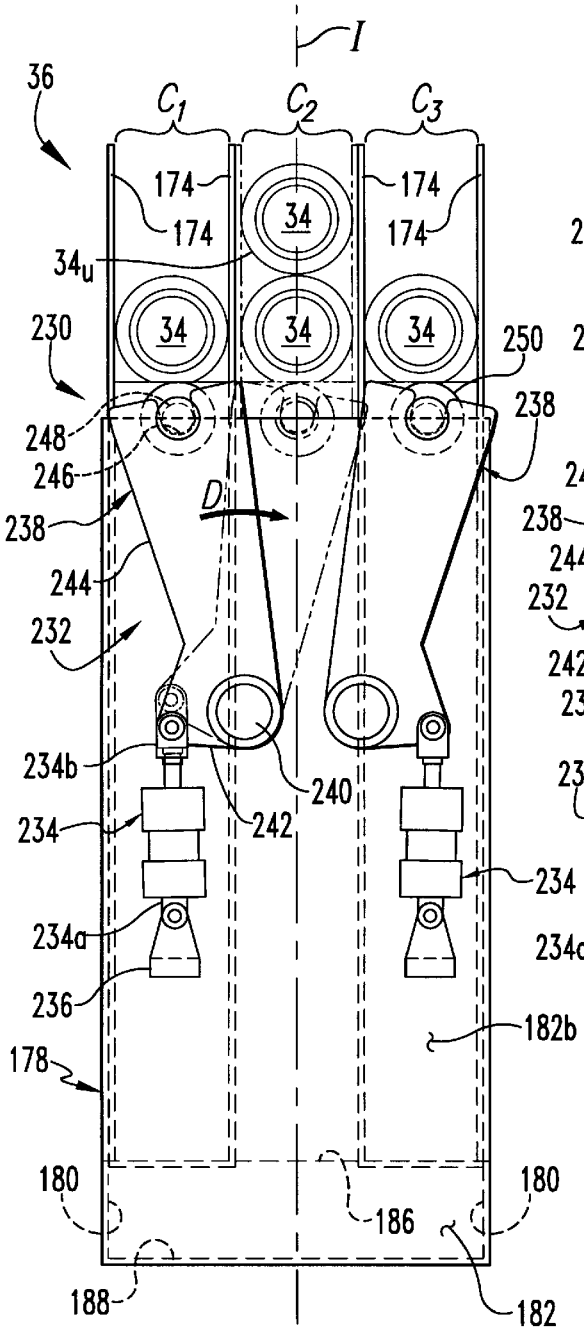
FIG. 9*b* is an end view of the rearward portion of the pipe storage and control rack depicted in FIG. 9*a*.
Figure 9A:
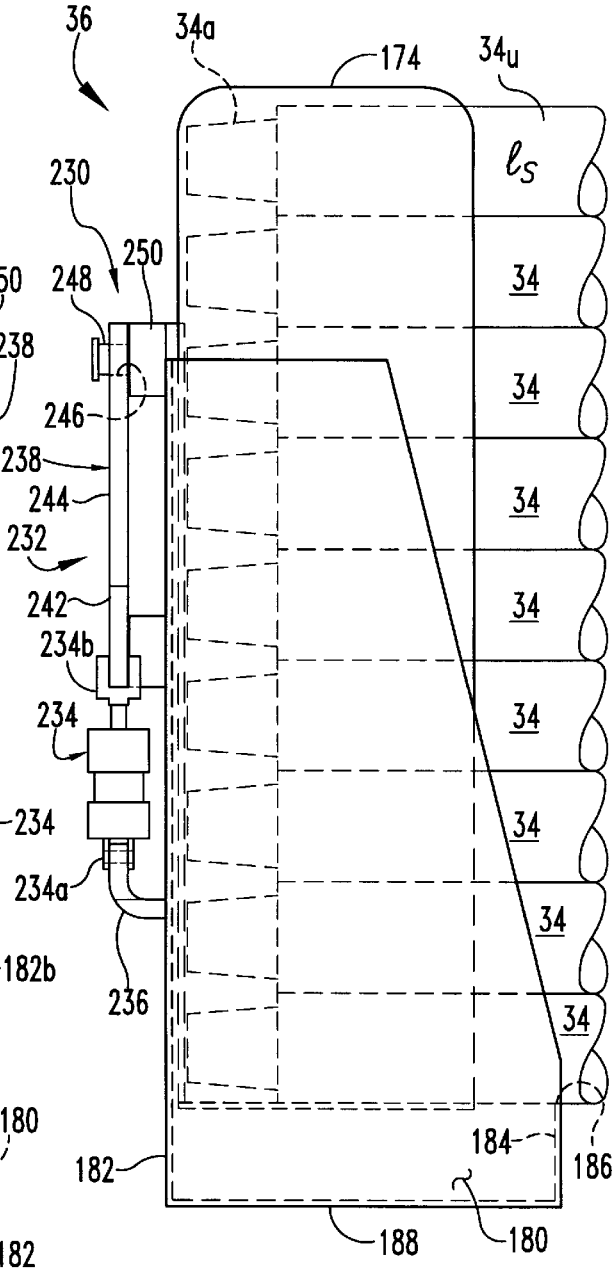
FIG. 9*a* is a side view of a rearward portion of the pipe storage and control rack depicted in FIG. 7.

Referring now to FIGS. 9*a* and 9*b*, shown therein is another component of pipe storage and control rack assembly 36. Pipe shifting assembly 230 includes four shifting mechanisms 232, each being associated with a corresponding U-shaped support member 174 of pipe support assemblies 172, 174. Each shifting mechanism 232 includes a hydraulic shifting cylinder 234 having a cylinder end 234*a* pivotally connected to the end wall 182 of mounting bracket 178 by a mounting flange 236 welded to outer surface 182*b*. A generally L-shaped actuator bracket 238 is pivotally connected to the outer surface 182*b* by way of a mounting pin 240. Actuator bracket 238 includes a horizontally extending first portion 242 and an upwardly extending second portion 244. The rod end 234*b* of shifting cylinder 234 is pivotally connected to the first portion 242 of actuator bracket 238. The upper end of the second portion 244 of actuator bracket 238 defines a slot or recess 246 configured to engage a stem portion 248 extending horizontally from a mounting block 250 attached to the vertical legs of a support member 174.

When all of the drill pipes 34 are removed from the inner pipe column $C_2$, the indexing cylinder 196 is retracted so that the lifting beam 206 is positioned below the lower-most pipes $\mathbf{34}_l$ in outer pipe columns $C_1$, $C_3$ (FIG. 8) and the shifting cylinder 234 is then extended. Actuation of the shifting cylinder 234 pivots the actuator bracket 238 in the direction of arrow D, toward the indexing axis I, and repositions the actuator bracket 238 and the corresponding support member 174 from their initial position (shown in solid) to a shifted position (shown in phantom). The simultaneous actuation of the shifting mechanisms 232 disposed at opposite ends of the outer pipe column $C_1$ correspondingly shifts outer pipe column $C_1$ in a horizontal direction and repositions the outer pipe column $C_1$ along the indexing axis I.

Upon the removal of all of the drill pipes 34 from the vertical pipe column $C_1$ (now shifted to a position along indexing axis I), the shifting cylinders 234 for that pipe column are retracted and the corresponding actuator brackets 238 and U-shaped support members 174 are returned to their original locations (shown in solid). At this point, the simultaneous actuation of the opposing shifting mechanisms 232 associated with outer pipe column $C_3$ correspondingly shifts outer pipe column $C_3$ in a horizontal direction and repositions the remaining drill pipes 34 along the indexing axis I. The remaining drill pipes 34 can then the incrementally indexed along indexing axis I and removed and repositioned by control arm assembly 32.

It should be understood that the order in which outer pipe columns $C_1$, $C_3$ are horizontally shifted and repositioned along indexing axis I is irrelevant. For example, upon the removal of the drill pipes 34 from the inner pipe column $C_2$, outer pipe column $C_3$ could be shifted to the center position, followed by the horizontal shifting of outer pipe column $C_1$ to the center position. It should also be understood that the horizontal shifting of outer pipe columns $C_1$, $C_3$ could be accomplished by other types and configurations of shifting mechanisms, as would be apparent to one of ordinary skill in the art.

Figure 10:
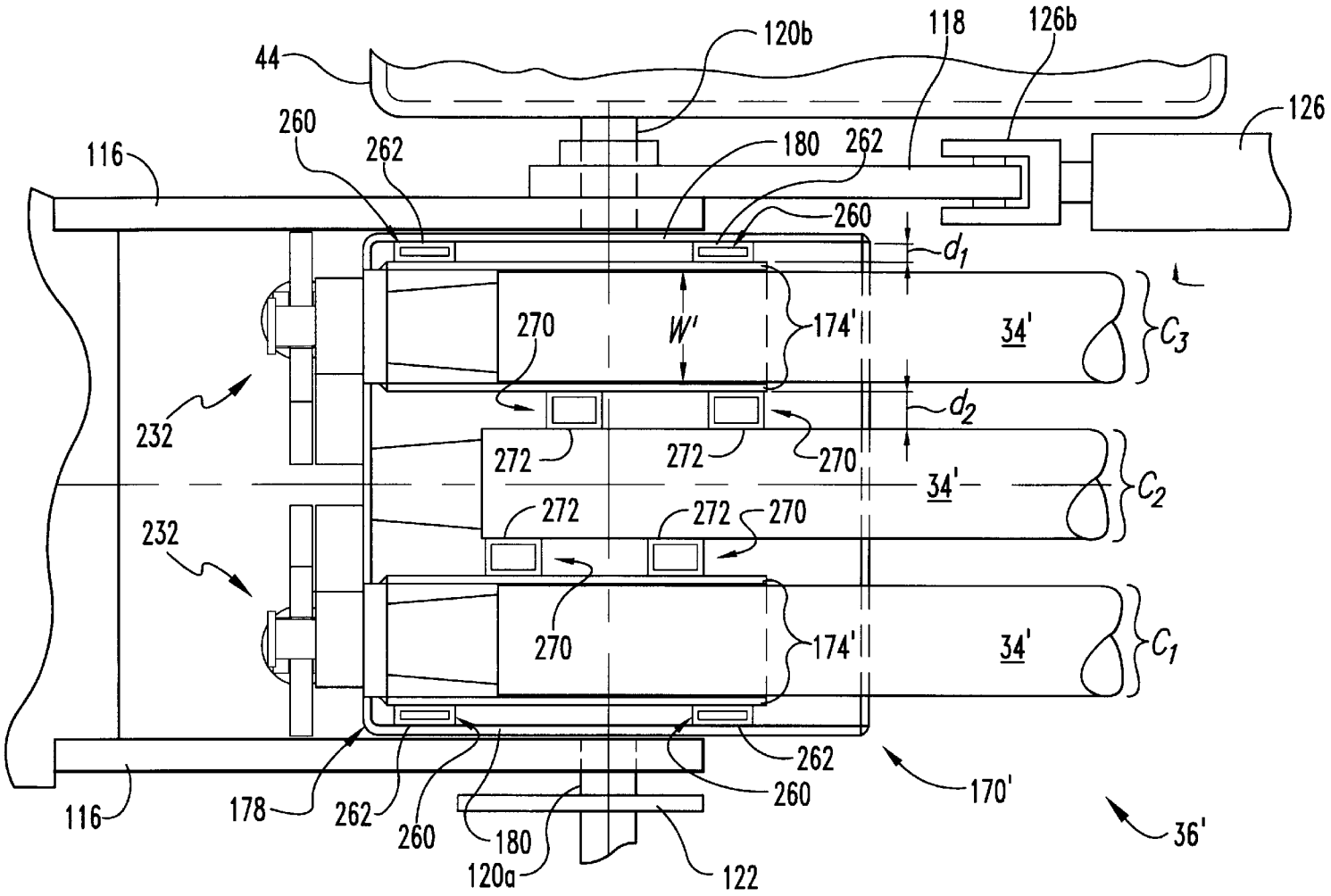
FIG. 10 is partial top view of another embodiment of the pipe storage and control rack, modified to accommodate a smaller diameter drill pipe.
Figure 11:
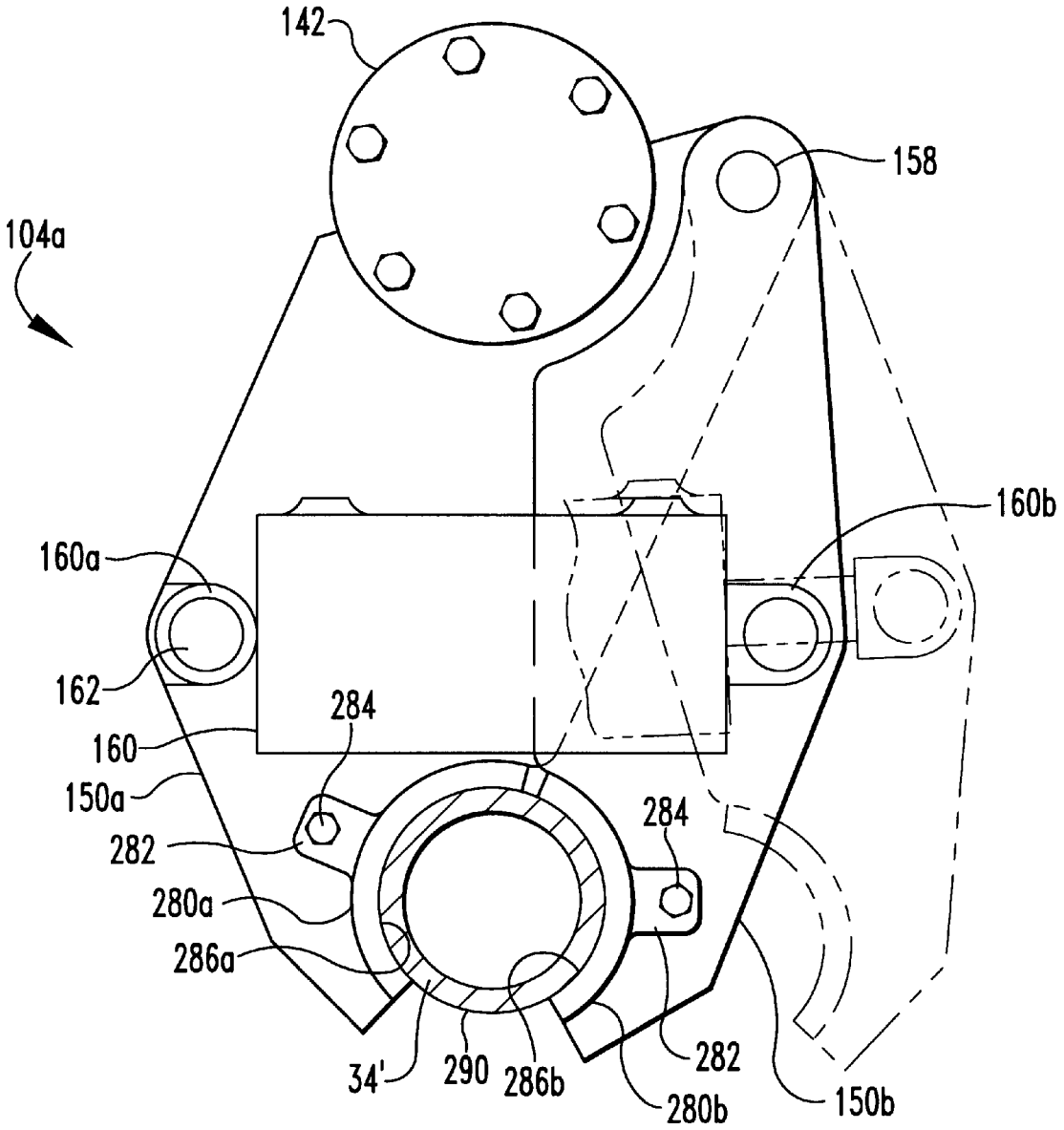
FIG. 11 is a cross sectional view of another embodiment of the control arm, modified to accommodate a smaller diameter drill pipe.
Figure 12:
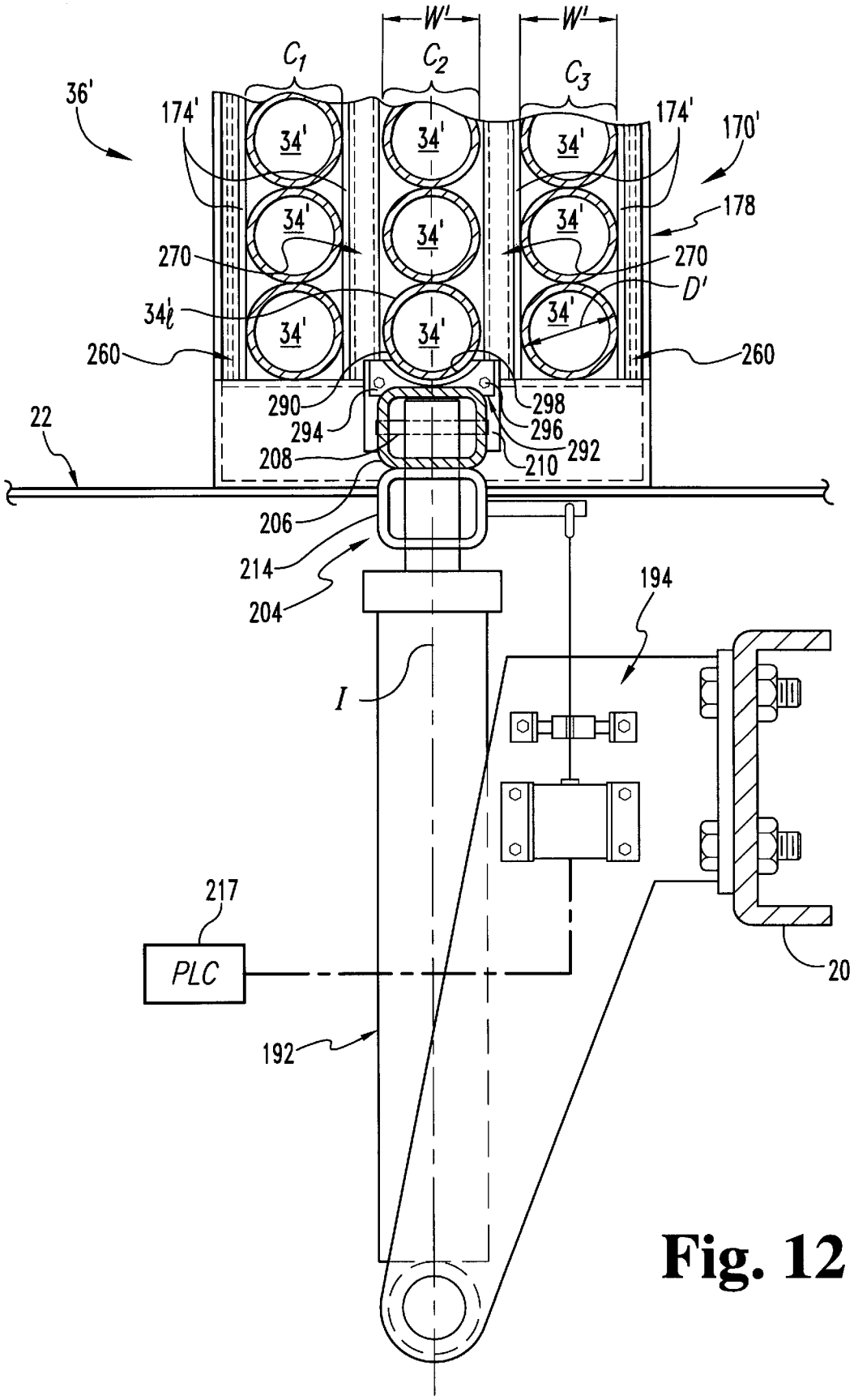
FIG. 12 is a cross sectional view of another embodiment of the indexing mechanism, modified to accommodate a smaller diameter drill pipe.

Referring now to FIGS. 10–12, shown therein is another embodiment of the present invention, as modified to accommodate a smaller diameter drill pipe 34'. In the illustrated embodiment, the drill pipes 34' are similar to drill pipes 34, with the exception of having a smaller outer diameter D' of 3½". Referring specifically to FIG. 10, shown therein is the rearward pipe support assembly 170'. Support members 174', which capture and maintain the outer pipe columns $C_1$, $C_3$, are configured similar to the support members 174 described above, with the exception of having a narrower channel width W'. Channel width W' is slightly wider than the outer diameter of drill pipes 34'. The inner pipe column $C_2$ is supported and maintained between the opposing outer support members 174'.

In order to maintain the proper spacing between pipe columns $C_1$, $C_2$, $C_3$, and to accurately position the pipe columns relative to the indexing mechanism 192 and the shifting mechanisms 232, spacers are attached to the outer surfaces of the vertical legs of support members 174'. Two outer spacers 260 are securely attached, preferably by welding, to the outer leg of each of the support members 174'. Outer spacers 260 are arranged in a substantially vertical orientation and extend virtually the entire height of support member 174'. Each outer spacer 260 has an outer surface 262 facing the side wall 180 of mounting bracket 178. In the illustrated embodiment, the outer spacers 260 are fabricated from structural steel tubing having a depth $d_1$ of approximately ½"; however, other types of structural members are also contemplated as would be apparent to one of ordinary skill in the art.

Two inner spacers 270 are securely attached, preferably by welding, to the inner leg of each of the support members 174'. Inner spacers 270 are arranged in a substantially vertical orientation and extend virtually the entire height of support members 174'. Each inner spacer 270 has an inner surface 272 facing the drill pipes 34' in inner pipe column $C_2$ and being in a plane substantially parallel to the indexing axis I (FIG. 8). Notably, the inner spacers 270 associated with one of the support members 174' are offset relative to the inner spacers 270 associated with the other support member 174'. The offset is required so that when either of the outer pipe columns $C_1$, $C_3$ is shifted and repositioned along the indexing axis I, the opposing pairs of inner spacers 270 will not interfere with one another. In the illustrated embodiment, the inner spacers 270 are fabricated from structural steel tubing having a depth $d_2$ of 1"; however, other types of structural members are also contemplated as would be apparent to one of ordinary skill in the art. Although not illustrated in FIG. 10, it should be understood that a similar spacer arrangement is also required for the forward pipe support assembly 172' (not shown).

It should now be understood that outer spacers 260 and inner spacers 270 serve to maintain the proper orientation and position of pipe columns $C_1$, $C_2$, $C_3$ relative to indexing mechanism 192, shifting mechanisms 232, and the control arm assembly 32. It should further be understood that by using smaller diameter drill pipes 34', the drilling capacity of the drilling rig 12 is correspondingly increased. In the illustrated embodiment, the pipe rack assembly 36' has the capacity to store thirty-one 3½" diameter drill pipes 34', with ten drill pipes stored in each of the outer pipe columns $C_1$, $C_3$ and eleven drill pipes stored in the inner pipe column $C_2$. Pipe rack assembly 36' is thus capable of supplying enough drill pipes 34' to accommodate well depths up to 620'.

Referring now to FIG. 11, shown therein is clasp member 104*a* modified to accommodate the smaller diameter drill pipes 34'. Two bushings 280*a*, 280*b* are detachably mounted to opposing jaws 150*a*, 150*b*, respectively. Each bushing 280*a*, 280*b* includes a flange 282 extending perpendicularly therefrom, which is attached to a corresponding jaw 150*a*, 150*b* by a fastener 284. The bushings 280*a*, 280*b* have opposing concave surfaces 286*a*, 286*b* which define a seat for engaging the outer surface 290 of drill pipes 34'. Although not illustrated in FIG. 11, it should be understood that a similar bushing arrangement is also required to modify lower clasp member 104*b* of control arm assembly 32.

Referring now to FIG. 12, shown therein is the indexing mechanism 192, modified to accommodate the smaller diameter drill pipes 34'. A bushing 292 is detachably mounted to contoured end plate 210 of lifting beam 206. Bushing 292 includes a flange 294 attached to end plate 210 by fasteners 296. The bushings 292 define a seat 298 for engaging the outer surface 290 of drill pipes 34'. Although not illustrated in FIG. 12, it should be understood that a similar bushing arrangement is also required to modify the end plate 210 disposed at the opposite end of lifting beam 206. It should also be understood that the PLC 217 of indexing control system 194 must be reprogrammed with a different look-up table of values to compensate for the smaller outer diameter of drill pipes 34'. The new values will be in increments corresponding to the outer diameter of the drill pipe 34'.

It should now be apparent that the present invention can be quickly and easily modified to accommodate drill pipes having different outer diameters by making relatively minor and inexpensive changes to the pipe rack assembly and the control arm assembly. Additionally, the drill head assembly 60 (FIG. 3) and the bearing table 90 disposed at the rear end of chassis 16 also require relatively minor modifications, the details of which would be apparent to one of ordinary skill in the art.

OPERATION

After the mobile drilling rig 12 has been transported to the drilling site and positioned in the proper drilling location, the leveling jacks 40 (FIG. 1) are deployed and the other usual steps are taken in preparation for drilling. Referring to FIG. 3, the derrick assembly 30 is then raised to a substantially vertical orientation by actuating the lifting cylinder 54. The drill head assembly 60 is upwardly displaced along longitudinal axis $L_1$ and positioned in its upper-most location on the mast 42, with the drilling axis D disposed along the site where the hole is to be drilled.

The control arm assembly 32, which is still in its horizontal operating position (shown in phantom), engages the upper-most drill pipe $\mathbf{34}_u$, located in the predetermined selection location $l_s$. Specifically, the opposing jaws 150*a*, 150*b* of upper and lower clasp members 104*a*, 104*b* clamp tightly about the upper-most drill pipe $\mathbf{34}_u$ by retracting clamping cylinder 160. The pivoting cylinder 126 is then retracted to pivot control arm assembly 32 counter-clockwise, in the direction of arrow A, until the longitudinal axis $L_2$ is substantially parallel with the drilling axis D (shown in solid). At this point, the selected drill pipe $\mathbf{34}_s$ is oriented in a substantially vertical orientation. Referring to FIGS. 3 and 4, the hydraulic rotary actuator 148 is then actuated and the elongate member 102 is rotated counter-clockwise, in the direction of arrow B, until the selected drill pipe $\mathbf{34}_s$ is positioned in the predetermined connection location $l_c$ (shown in phantom). It is noted that the angular orientation of the selected drill pipe $\mathbf{34}_s$ is maintained while being transferred to the connection location $l_c$. At this point, the centerline of the selected drill pipe $\mathbf{34}_s$ is included within a vertical plane containing the drill axis D and the longitudinal axis $L_2$.

After the selected drill pipe $\mathbf{34}_s$ is positioned in the connection location $l_c$, the drill head 76 is horizontally displaced toward the connection location $l_c$, in the direction of arrow C, until positioned directly above the selected drill pipe $\mathbf{34}_s$. The drill head assembly 60 is then downwardly displaced until the externally threaded nipple 86 of the wear-sub 84 is positioned adjacent the upper internal threads of the selected drill pipe $\mathbf{34}_s$. The two hydraulic motors 92*a*, 92*b* are then simultaneously actuated to cause the externally threaded nipple 86 to threadedly engage the selected drill pipe $\mathbf{34}_s$. The upper and lower clasp members 104*a*, 104*b* are then disengaged from the selected drill pipe $\mathbf{34}_s$ and the drill head 76 is horizontally displaced toward its original location, opposite arrow C, until the selected drill pipe $\mathbf{34}_s$ is positioned along the drilling axis D. The drill bit 88 is then attached to the lower end of the selected drill pipe $\mathbf{34}_s$ and the motors 92*a*, 92*b* are actuated to cause the drill to penetrate the earth. Drilling continues until the upper end of the partially embedded drill pipe is located at an elevation approximately level with the chassis bed 22.

During the drilling operation, the rotary actuator 148 is operated to rotate the elongate member 102 of the control arm assembly 32 in a clockwise direction, opposite arrow B, swinging the clasp members 104*a*, 104*b* back into their original position facing pipe rack assembly 36 (shown in solid). Pivoting cylinder 126 is then extended to return the control arm assembly 32 to its original horizontal orientation (shown in phantom), pivoting control arm assembly 32 in a direction opposite arrow A, so that another drill pipe 34 can be picked up while the previous drill pipe is being drilled into the ground.

Referring to FIGS. 7 and 8, the indexing cylinder 196 is then actuated to engage the lifting beam 206 against the lower-most drill pipe $\mathbf{34}_l$ and index inner pipe column $C_2$ along indexing axis I until another drill pipe 34 is positioned in the predetermined selection location $l_s$. The control arm assembly 32 once again selectively grasps the upper-most drill pipe $\mathbf{34}_u$ and reorients the selected drill pipe $\mathbf{34}_s$ to a vertical attitude and repositions the selected drill pipe $\mathbf{34}_s$ to the connection location $l_c$.

The drill head 76 is then rotated in a direction opposite the drilling direction to detach the externally threaded nipple 86 from the drill pipe already partially embedded in the ground. The drill head 76 is then vertically displaced along longitudinal axis $L_1$ and returned to its upper-most position, and then horizontally displaced until positioned directly above the connection location $l_c$. The drill head 76 then engages the selected drill pipe $\mathbf{34}_s$ and connects the selected drill pipe $\mathbf{34}_s$ to the partially embedded drill pipe to thereby form a drilling string disposed along drilling axis D.

The process of incrementally indexing the inner pipe column $C_2$ and removing the upper-most drill pipe $\mathbf{34}_u$ is repeated until all of the drill pipes 34 are removed from the inner pipe column $C_2$. At this point, the indexing cylinder 196 is fully retracted and one of the outer pipe columns $C_1$ is horizontally shifted and positioned along the indexing axis I. The process of incrementally indexing and removing the drill pipes 34 is repeated until all of the drill pipes 34 are removed from the shifted pipe column. The indexing cylinder 196 is again retracted and the remaining outer pipe column $C_3$ is shifted and positioned along the indexing axis I. The process of incrementally indexing and removing the drill pipes 34 is once again repeated until all of the drill pipes are removed from the remaining pipe column. Although the above-described drilling process utilizes all of the drill pipes 34, it is obvious that a lesser number of drill pipes 34 may be required depending on the desired depth of the well to be drilled.

When the drilling operation is completed, the individual drill pipes 34 may be removed from the drilling string and transferred back to the pipe rack assembly 36 by a break-out process essentially opposite to the connection process outlined above. However, it should be understood that the drill string can remain in the ground if so desired. In brief summary, the control arm assembly 32 repositions each detached drill pipe 34 to the predetermined selection location $l_s$, wherein the removed drill pipe is downwardly displaced along indexing axis I by retracting indexing cylinder 196. The removal process is repeated until the inner pipe column $C_2$ is full, wherein it is shifted outwardly to form one of the outer pipe columns $C_1$, $C_3$. The removal process is again repeated until the inner pipe column is once again filled and shifted outwardly to form the other outer pipe column $C_1$, $C_3$. The remaining drill pipes 34 are then removed and positioned in the inner pipe column $C_2$.

Although the drilling process has been illustrated and described as a vertical drilling process, it should be understood that drilling at other angular attitudes is also contemplated as being within the scope of the invention. Referring to FIG. 3, the mast 42 is shown positioned in a vertical orientation for drilling a hole generally perpendicular to the surface of the ground. However, the mast 42 could alternatively be oriented in an angular drilling position, with the longitudinal axis $L_1$ being aligned at an angular attitude relative to the surface of the ground. In one embodiment, the mast 42 is oriented at a desired angular attitude by controlling the extension and retraction of the lifting cylinder 54, preferably through the PLC 217. The pivoting motion of the control an assembly 32 must also be controlled so as to orient the longitudinal axis $L_2$ at the same angular attitude as longitudinal axis $L_1$ so that the selected drill pipe 34, may be oriented at an angular orientation substantially parallel with the drilling axis D.

A suitable hydraulic system (not shown), powered by the diesel engine 24, is used to power all of the hydraulic cylinders and rotary actuators. It should be understood that additional hydraulic components, such as control valves, regulators, shuttle valves, hydraulic connectors, and hydraulic tubing, are incorporated into the hydraulic system, as would be apparent to one of ordinary skill in the art. It should also be understood that alternative means using compressed air or electric motors or actuators could be used to effect movements similar to those accomplished through the use of the hydraulic cylinders and rotary actuators discussed herein.

Although the pipe storage and control rack assembly 36 is configured to maintain a sufficient number of drill pipes 34 necessary to accommodate virtually all well depths currently encountered in the water well drilling industry, if additional drill pipes are required, they can be easily transferred from a service truck by way of a U-shaped pipe sling (not shown). The pipe sling would have a channel width substantially equal to the channel width of support members 174 or 174'. In the case of 4½" diameter drill pipes, the pipe sling would be configured to transfer eight drill pipes 34 in cartridge form from a pick-up location or service truck to the pipe storage rack 36. In the case of 3½" diameter drill pipes, the pipe sling would be configured to transfer ten drill pipes 34' in cartridge form. In one embodiment, the pipe sling could be suspended from the optional jib boom and hoist line described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A system for storing and manipulating a plurality of drill pipes on a base, comprising:

a pipe storage rack assembly disposed on said base, including:

a number of support members adapted to maintain said plurality of pipes in at least two adjacent and substantially parallel pipe columns, one of said pipe columns being positioned along an indexing axis;

an indexing mechanism coupled to said base and adapted to incrementally index said one of said pipe columns along said indexing axis to position the upper-most pipe in said one of said pipe columns to a predetermined selection location;

a shifting mechanism coupled between said base and one of said support members and adapted to shift another of said pipe columns in a direction transverse to said indexing axis to position said another of said pipe columns along said indexing axis; and a control arm coupled to said base adjacent to said pipe rack and adapted to remove said upper-most pipe from said selection location and reposition said upper-most pipe to a connection location for engagement to a utilization device.

2. The system of claim 1, wherein said indexing mechanism incrementally indexes said one of said pipe columns along said indexing axis in increments corresponding to an outer diameter of said pipes.

3. The system of claim 1, wherein said pipes are stored in said pipe rack in a substantially horizontal orientation; and wherein said indexing axis is disposed in a substantially vertical orientation.

4. The system of claim 1, wherein said indexing mechanism comprises a hydraulic cylinder coupled to said base and a pipe saddle coupled to said hydraulic cylinder, said pipe saddle being adapted to engage the lower-most pipe in said one of said pipe columns and displace said one of said pipe columns in a direction along said indexing axis upon actuation of said hydraulic cylinder.

5. The system of claim 4, wherein said pipe saddle spans at least one-third of the length of said pipes.

6. The system of claim 1, further comprising an indexing control system, including:

a sensor configured to sense the position of said one of said pipe columns along said indexing axis during said indexing, and to generate an output signal corresponding to said position; and a controller for receiving said output signal from said sensor and comparing said output signal to a target criterion, said controller generating a control signal when said output signal corresponds to said target criterion; and wherein said indexing mechanism receives said control signal and responds by ceasing said indexing to position said upper-most pipe in said predetermined selection location.

7. The system m of claim 6, wherein said target criterion is determined by said controller from a look-up table of values, said values being in increments equal to an outer diameter of said pipes.

8. The system of claim 6, wherein said sensor is an optical encoder having a stationary portion and a displaceable portion, said stationary portion being fixedly mounted relative to said one of said pipe columns, said displaceable portion being connected to an indexing portion of said indexing mechanism to sense the position of said one of said pipe columns along said indexing axis.

9. The system of claim 1, wherein said shifting mechanism comprises:

a hydraulic cylinder coupled between said base and said one of said support members; and an actuator bracket pivotally coupled to said base, a first portion of said actuator bracket engaging said hydraulic cylinder and a second portion of said actuator bracket engaging said one of said support members; and wherein actuation of said hydraulic cylinder in one direction pivots said second portion of said actuator bracket toward said indexing axis and positions said another of said pipe columns along said indexing axis; and wherein actuation of said hydraulic cylinder in an opposite direction pivots said second portion of said actuator bracket away from said indexing axis and returns said one of said support members to its original location.

10. The system of claim 1, wherein said support members are adapted to maintain said plurality of pipes in three adjacent and substantially parallel pipe columns including a pair of outer pipe columns and an inner pipe column, each of said outer pipe columns being maintained by at least one corresponding support member, each corresponding support member being coupled to a corresponding shifting mechanism, said inner pipe column being maintained between said outer pipe columns; and wherein upon the removal of each of said pipes from said inner pipe column, one of said outer pipe columns is shifted in a first direction toward said indexing axis by actuating said corresponding shifting mechanism to position said one of said outer pipe columns along said indexing axis; and wherein upon the removal of said pipes from said one of said outer pipe columns, another of said outer pipe columns is shifted in a second direction opposite said first direction by actuating said corresponding shifting mechanism to position said another of said outer pipe columns along said indexing axis.

11. The system of claim 10, wherein each of said support members is substantially U-shaped and has a channel width sized slightly larger than an outer diameter of said pipes.

12. The system of claim 10, wherein each of said outer pipe columns is maintained by a pair of support members disposed adjacent opposite ends of said pipes; and wherein each of said pairs of support members is associated with a corresponding pair of shifting mechanisms such that each of said pair of support members is displaced in a direction transverse to said indexing axis upon simultaneous actuation of said corresponding pair of said shifting mechanisms.

13. The system of claim 12, wherein said pipe rack further includes a pair of opposing mounting brackets, each of said mounting brackets having an end wall oriented substantially parallel to said indexing axis, each end wall defining an inner surface and an outer surface, said inner surface of each of said end walls being disposed adjacent a corresponding one of said opposite ends of said pipes; and wherein each of said shifting mechanisms comprises a hydraulic cylinder having a cylinder portion coupled to said outer surface of said end wall of a corresponding mounting bracket and a rod portion coupled to a corresponding one of said support members.

14. The system of claim 1, wherein said control arm comprises:

a pedestal member pivotally coupled to said base;

an elongate member coupled to said pedestal member;

at least one clasp member coupled to said elongate member; and wherein said transfer arm is operable to selectively grasp said upper-most pipe in said selection location with said at least one clasp member and reorient said selected pipe from an initial stored attitude to a different connection attitude for connection to said utilization device.

15. The system of claim 14, wherein said stored attitude is substantially horizontal and said connection attitude is substantially vertical.

16. The system of claim 14, wherein said at least one clasp member comprises:

a pair of opposing jaws, each of said jaws having a seat configured to engage an outer surface of said selected pipe, at least one of said jaws being pivotally coupled to said elongate member; and a hydraulic cylinder having a cylinder portion connected to one of said jaws and a rod portion connected to another of said jaws; and wherein actuation of said hydraulic cylinder in one direction closes said pair of opposing jaws to grip said selected pipe and wherein actuation of said hydraulic cylinder in an opposite direction opens said opposing jaws to release said selected pipe.

17. The system of claim 14 wherein said base is a drilling rig and said utilization device is a drill head; and wherein said drilling rig has a mast pivotally coupled thereto with said drill head being coupled to said mast, said mast having a longitudinal axis and being adapted to pivot between a transportation position and a drilling position, said drill head being movable in a first direction generally along said longitudinal axis and in a second direction generally perpendicular to said longitudinal axis; and wherein said mast is pivoted to said connection attitude and said drill head is positioned above said connection location for connection of said selected pipe to said drill head.

18. The system of claim 17, wherein said elongate member is rotatably coupled to said pedestal member for rotation about a rotational axis oriented at said connection attitude, said control arm being operable to rotate said selected pipe about said rotational axis toward said connection location while maintaining said selected pipe at said connection attitude.

19. The system of claim 18, wherein said elongate member is coupled to a hydraulic rotary actuator for rotating said selected pipe about said rotational axis.

20. The system of claim 17, wherein said drilling position and said connection attitude are each substantially vertical.

21. A combination, comprising:

a mobile drilling rig having a chassis bed;

a derrick mounted to said chassis bed and adapted for movement between a transportation position and a drilling position;

a drill head coupled to said derrick and being movable along a length of said derrick when said derrick is in said drilling position;

means for supporting a plurality of horizontally disposed drill pipes on said chassis bed in at least two adjacent vertical pipe columns;

means for incrementally indexing one of said pipe columns in a vertical direction until the upper-most pipe in said one of said pipe columns is disposed in a predetermined selection location;

means for repositioning said upper-most pipe from said selection location to a connection location for engagement of said upper-most pipe to said drill head; and means for shifting another of said pipe columns in a horizontal direction until said another of said pipe columns is positioned above said indexing means.

22. The combination of claim 21, wherein said repositioning means includes means for gripping said upper-most pipe and means for reorienting said upper-most pipe from said horizontal disposition to an angular disposition corresponding to said drilling position of said derrick.

23. The combination of claim 22, wherein said repositioning means includes means for swinging said upper-most pipe toward said connection location while maintaining said angular disposition.

24. The combination of claim 21, further comprising means for monitoring the vertical position of said one of said pipe columns and means for controlling said indexing based on said vertical position to position said upper-most pipe in said predetermined selection location.

25. The combination of claim 21, wherein said drill head is movable across a width of said derrick.

26. The combination of claim 21, further comprising means for adapting said combination to accommodate different outer diameters of said drill pipes.

27. A method for manipulating drill pipes on a drilling rig, comprising:

providing a plurality of drill pipes disposed in a substantially horizontal orientation, the drill pipes being retained in at least two adjacent pipe columns, a first of the pipe columns being positioned along an indexing axis;

indexing the first pipe column in a vertical direction along the indexing axis until the upper-most drill pipe is positioned at a predetermined selection location;

repositioning the upper-most drill pipe from the predetermined selection location to a predetermined connection location;

repeating the indexing and repositioning until all of the drill pipes are removed from the first pipe column; and shifting a second pipe column in a horizontal direction until the second pipe column is positioned along the indexing axis.

28. The method of claim 27, further comprising providing a control arm having at least one grasping portion, and wherein the repositioning includes selecting the upper-most drill pipe by gripping the upper-most drill pipe with the at least one grasping portion and pivoting the control arm until the selected drill pipe is oriented substantially parallel with a drilling axis of the drilling rig.

29. The method of claim 28, further comprising rotating the control arm about a rotation axis oriented substantially parallel with the drilling axis until the selected drill pipe is positioned in said predetermined connection location.

30. The method of claim 28, further comprising:

providing a derrick assembly pivotally mounted to the drilling rig and a drill head movably coupled to the derrick assembly and adapted to support a string of drill pipes and rotate the string of drill pipes about the drilling axis;

positioning the drill head directly above the selected drill pipe, engaging the drill head to the selected drill pipe, releasing the gripping of the selected drill pipe, realigning the drill head with the drilling axis and connecting the selected drill pipe to the string of drill pipes.

31. The method of claim 27, further comprising:

repeating the indexing and repositioning until all of the drill pipes are removed from the second pipe column; and shifting a third pipe column in a horizontal direction until the third pipe column is positioned along the indexing axis.

32. The method of claim 27, further comprising controlling the indexing by monitoring the position of the first pipe column during the indexing and stopping the indexing when the upper-most drill pipe is positioned at the predetermined selection location.

33. The method of claim 32, wherein the indexing occurs in increments corresponding to an outer diameter of the drill pipes.

* * * * *

UNITED STATES PATENT AND TRADEMARK OFFICE

CERTIFICATE OF CORRECTION

PATENT NO. : 6,298,927 B1
DATED : October 9, 2001
INVENTOR(S) : Carl F. Back

It is certified that error appears in the above-identified patent and that said Letters Patent is hereby corrected as shown below:

Title page,

Item [56], after U.S. PATENT DOCUMENTS, please insert:

| | | | |
|---|---|---|---|
| -- 2,878,963 | 03/24/59 | Bucci et al. | 221/190 |
| 3,616,941 | 11/02/71 | Walling | 214/IPB |
| 3,734,208 | 05/22/73 | Otto | 175/52 |
| 3,734,210 | 05/22/73 | Wilderman | 175/85 |
| 3,795,326 | 03/05/74 | Neilon et al. | 214/2.5 |
| 3,844,420 | 10/29/74 | Walling et al. | 214/1P |
| 3,978,994 | 09/07/76 | Woolslayer et al. | 214/2.5 |
| 4,049,130 | 09/20/77 | Bell | 214/8.5A |
| 4,258,796 | 03/31/81 | Horning et al. | 175/52 |
| 4,552,498 | 11/12/85 | Dysarz | 414/22 |
| 4,600,120 | 07/15/86 | Sabo et al. | 221/107 |
| 4,718,805 | 01/12/88 | Becker | 414/22 |
| 4,809,882 | 03/07/89 | Neu | 221/238 |
| 4,834,604 | 05/30/89 | Brittain et al. | 414/22.55 |
| 4,892,160 | 01/09/90 | Schivley, Jr. et al. | 175/85 |
| 4,936,736 | 06/26/90 | Meier | 414/746.1 |
| 5,094,302 | 03/10/92 | Back | 173/28 |
| 5,167,345 | 12/01/92 | Bleeker | 221/17 |
| 5,297,642 | 03/29/94 | Rajakallio et al. | 175/85 |
| 5,458,454 | 10/17/95 | Sorokan | 414/786 |
| 5,697,457 | 12/16/97 | Back | 173/185 |
| 5,795,107 | 08/18/98 | Demondson et al. | 405/303 -- |

UNITED STATES PATENT AND TRADEMARK OFFICE

CERTIFICATE OF CORRECTION

PATENT NO. : 6,298,927 B1
DATED : October 9, 2001
INVENTOR(S) : Carl F. Back

It is certified that error appears in the above-identified patent and that said Letters Patent is hereby corrected as shown below:

Item [56], cont'd.
At the end of U.S. PATENT DOCUMENTS, please insert:
-- OTHER PUBLICATIONS
*TH100A Angle Drill*, Ingersoll-Rand Rotary Drills, Form 4470-C © 1989 by Ingersoll-Rand Co.
*Ingersoll-Rand T4W Waterwell Drill*, Ingersoll-Rand Construction & Mining, Form 87116-B © 1997 Ingersoll-Rand Co.
*TH60 Waterwell Drill*, Ingersoll-Rand Drilling Equipment, Form 4407-F © Ingersoll-Rand Company
*Ingersoll-Rand T2W Waterwell Drill*, Ingersoll-Rand Construction & Mining, T2W Waterwell Drill © 1996 Ingersoll-Rand Co. --.

Signed and Sealed this

Twenty-fourth Day of September, 2002

*Attest:*

*Attesting Officer*

JAMES E. ROGAN
*Director of the United States Patent and Trademark Office*